US007397005B2

(12) United States Patent
Kang

(10) Patent No.: US 7,397,005 B2
(45) Date of Patent: Jul. 8, 2008

(54) CONTROL PANEL ASSEMBLY FOR WASHING MACHINE

(75) Inventor: Dong Won Kang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 616 days.

(21) Appl. No.: 10/717,967

(22) Filed: Nov. 21, 2003

(65) Prior Publication Data

US 2004/0148972 A1 Aug. 5, 2004

(30) Foreign Application Priority Data

Nov. 28, 2002 (KR) ..... 10-2002-0075035

(51) Int. Cl.
*H01H 1/64* (2006.01)

(52) U.S. Cl. ..... 200/293; 200/313; 200/317

(58) Field of Classification Search ..... 200/293, 200/296, 302.2, 336, 19.18, 33 R, 38 R, 310–317, 200/6 A See application file for complete search history.

(56) References Cited

U.S. PATENT DOCUMENTS

| | | | | |
|---|---|---|---|---|
| 5,350,140 | A * | 9/1994 | Ripley et al. | 248/27.1 |
| 5,464,955 | A * | 11/1995 | Cole | 200/317 |
| 5,650,601 | A * | 7/1997 | Krueger et al. | 200/61.86 |
| 5,669,489 | A * | 9/1997 | von Ende | 200/570 |
| 6,288,349 | B1 * | 9/2001 | Motyka et al. | 200/296 |
| 6,288,351 | B1 * | 9/2001 | Bruntz | 200/336 |
| 6,344,618 | B1 * | 2/2002 | Sato | 200/6 A |
| 6,507,967 | B2 * | 1/2003 | Johnson | 8/159 |
| 6,531,669 | B1 * | 3/2003 | Miller et al. | 200/313 |

* cited by examiner

*Primary Examiner*—K. Richard Lee
(74) *Attorney, Agent, or Firm*—Ked & Associates LLP

(57) ABSTRACT

Disclosed is a control panel assembly for a washing machine, which provides an improved structure enabling a knob smoothly to rotate without making noise. The present invention includes a board having a switch and parts mounted thereon, a control panel installed at one side of a cabinet of the washing machine to cover the board to protect, and a knob connected to the switch to penetrate the control panel wherein a rear end is partially contacted with a backside of the control panel.

20 Claims, 5 Drawing Sheets

CONTROL PANEL ASSEMBLY FOR WASHING MACHINE

This application claims the benefit of Korean Application(s) No. 10-2002-0075035 filed on Nov. 28, 2002, which is/are hereby incorporated by reference.

BACKGROUND OF THE INVENTION

1. Field of the Invention

The present invention relates to a washing machine, and more particularly, to a control panel assembly for a washing machine, which provides an improved structure enabling a knob smoothly to rotate without making noise.

2. Discussion of the Related Art

Generally, a washing machine is an apparatus for eliminating dirt or filth attached to a laundry using reaction between water and detergent.

Such a washing machine is classified into a pulsator type, an agitator type, and a drum type. The agitator type washing machine rotates an agitator protruding from a bottom center of a tub in forward and reverse directions to perform washing. The pulsator type washing machine rotates a disc-type pulsator on a bottom of a tub in forward and reverse directions to perform washing using a frictional force between a generated current and a laundry. And, the rum type washing machine rotates a drum holding water, detergent, and laundry at low speed to perform washing. In this case, a plurality of tumbling ribs protrude from an inside of the tub.

Meanwhile, a control panel assembly is provided on a front or top side of the washing machine so that a user manipulates the washing machine. Such a control panel assembly consists of a board having switch and electric parts mounted thereon, a panel covering the board, and a knob connected to the switch. In this case, the knob penetrates the panel to be exposed on a top of the panel. And, a flange is provided at a circumference of a lower end of the knob. The flange is brought contact with a backside of the panel to prevent the knob from being separated.

However, when the user turns the knob to operate the washing machine, a shaft of the switch is simultaneously turned to output a control signal to a control unit (not shown in the drawing). In this case, the knob is turned while an entire one surface of the flange is contacted in plane with the backside of the panel. Hence, a contact area between the panel and the flange of the knob is considerably large to interrupt the rotation of the knob and to make a big frictional noise.

SUMMARY OF THE INVENTION

Accordingly, the present invention is directed to a control panel assembly for a washing machine that substantially obviates one or more of the problems due to limitations and disadvantages of the related art.

An object of the present invention, which has been devised to solve the foregoing problem, lies in providing a control panel assembly for a washing machine, which provides an improved structure enabling a knob smoothly to rotate without making noise.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a control panel assembly for a washing machine including a board having a switch and parts mounted thereon, a control panel installed at one side of a cabinet of the washing machine to cover the board to protect, and a knob connected to the switch to penetrate the control panel wherein a rear end is partially contacted with a backside of the control panel.

In another aspect of the present invention, there is provided a control panel assembly of a washing machine including a board having a switch and parts mounted thereon, a control panel installed at one side of a cabinet of the washing machine to cover the board to protect, the control panel having an opening, a display plate provided to the opening to have a hole at a center of the display plate, and a knob connected to the switch to penetrate the hole of the control panel wherein a rear end of the knob is partially contacted with a backside of the control panel.

Meanwhile, the control panel assembly further includes a support provided between the board and the knob to support the knob slant to the backside of the control panel or the display plate.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
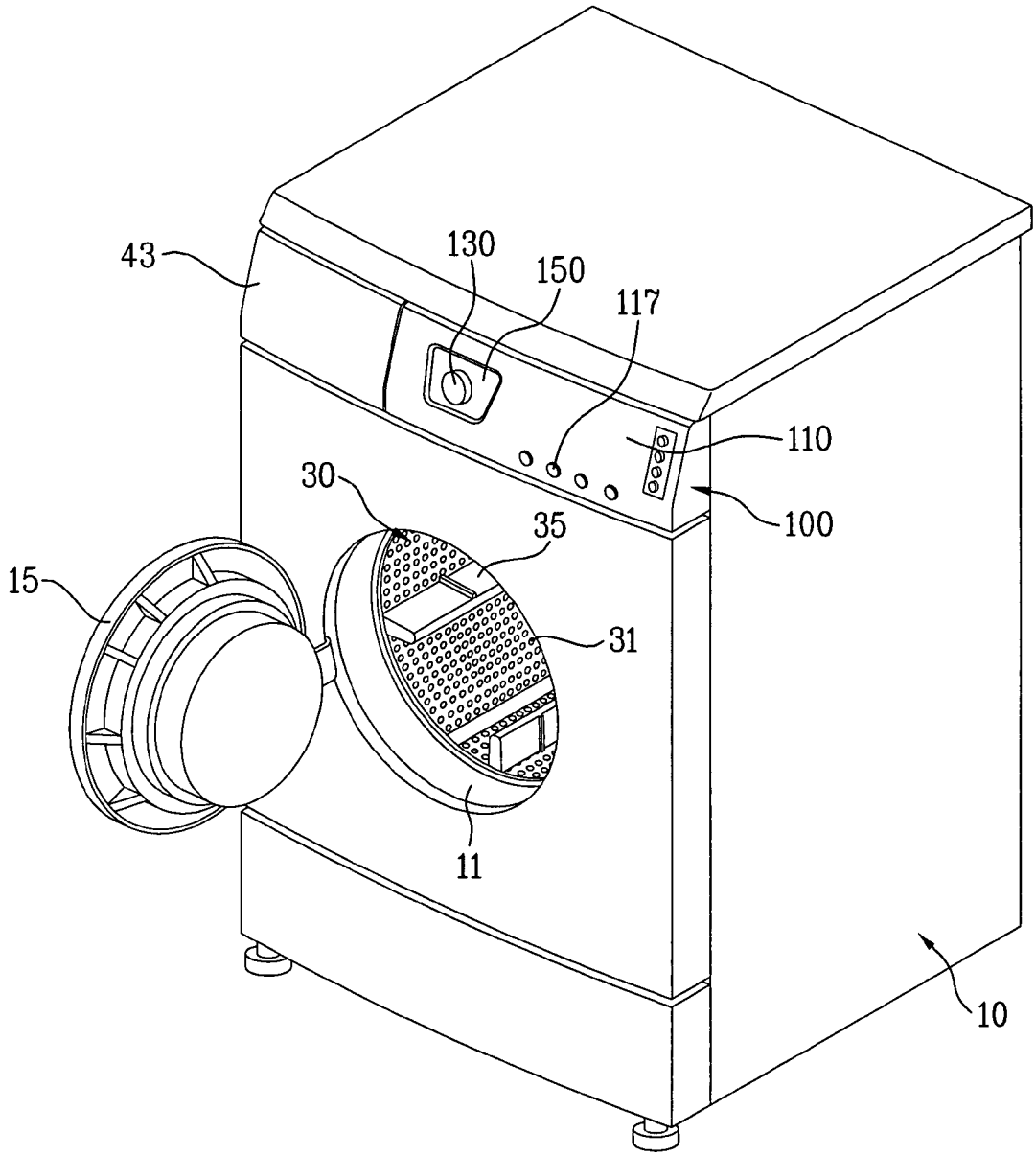
FIG. 1 is a perspective view of a washing machine according to one embodiment of the present invention.
Figure 2:
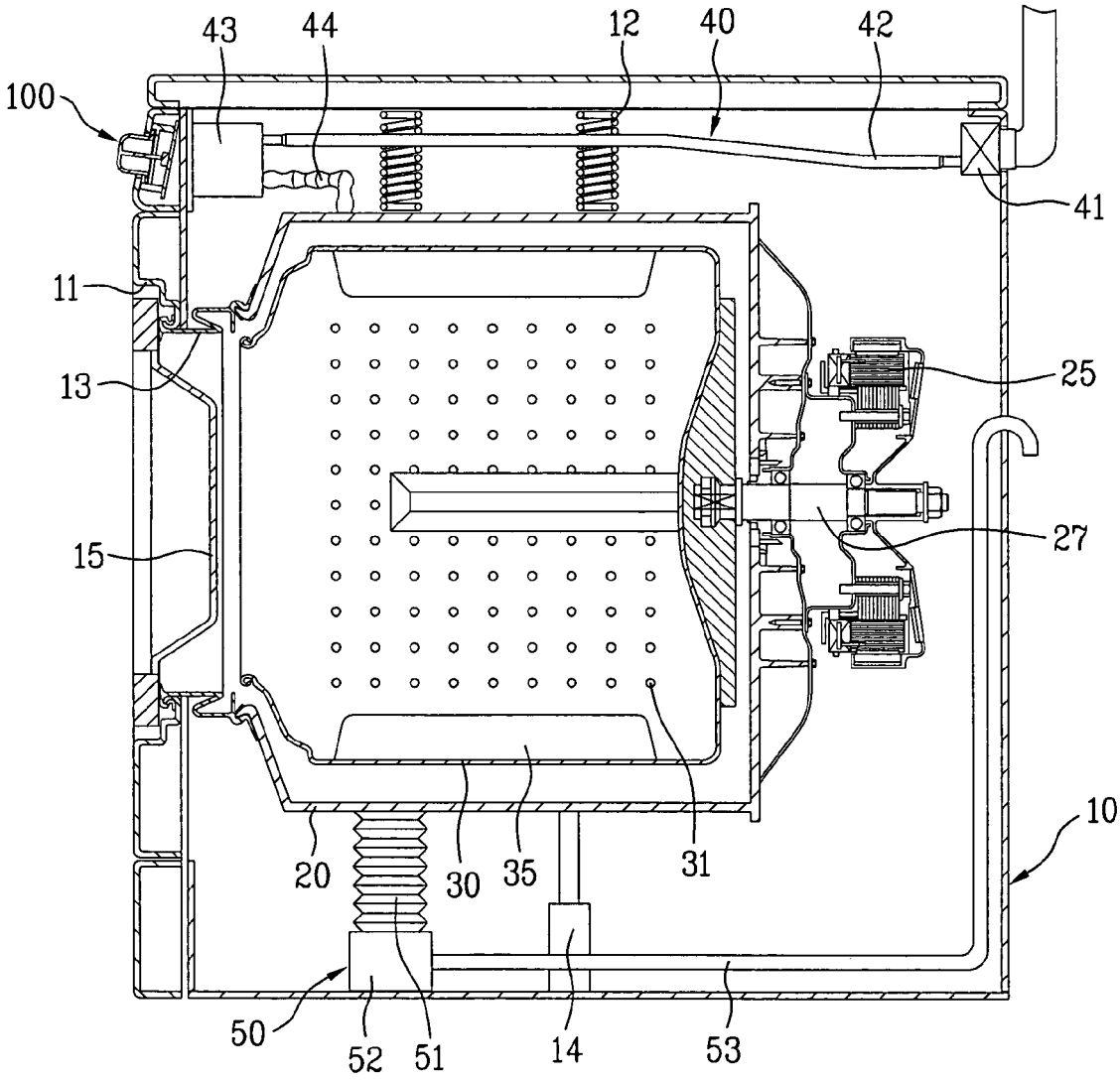
FIG. 2 is a cross-sectional view of a washing machine in FIG. 1.

FIG. 1 is a perspective view of a washing machine according to one embodiment of the present invention and FIG. 2 is a cross-sectional view of a washing machine in FIG. 1.

Referring to FIG. 1 and FIG. 2, a tub 20 is suspended in a cabinet 10. For this, a top of the tub 20 is connected to a spring 12 fixed to the cabinet 10 and a bottom of the tub 20 is connected to a damper 14 hinge-connected to a bottom of the cabinet 10. The spring 12 and damper 14 elastically suspend the tub 20 in the cabinet 10 as well as attenuate vibrations appearing on the tub 20 on operating the washing machine.

A drum 30 is rotatably provided in the tub 20. For this, a motor 25 is provided in the cabinet, and more specifically, in rear of the tub 20, and the drum 30 is connected to the motor 25 via a shaft 27.

A plurality of tumbling ribs 35 are provided on an inner circumference of the drum 30 and a multitude of perforated holes 31 penetrate into an outer circumference of the drum 30, whereby water supplied in the tub 20 enables to communicate between the tub 20 and the drum 30 via the perforated holes 31. Meanwhile, the laundry is lifted up by the tumbling ribs 35 to fall down while the drum 30 rotates, by which frictional and shock energy is sufficiently attained for washing.

An entrance 11 is provided at a front side of the cabinet 10 to put a laundry in/out of the drum 30. A door 15 is provided at the entrance 11 to open/close. A gasket 13, as shown in FIG. 2, is provided between the entrance 11 and an opening of the tub 25 to prevent the water held in the drum and tub 30 and 20 from leaking. And, an open top of the cabinet 10 is covered with a top plate 20.

A water supply assembly 40 and a drain assembly 50 are provided in the cabinet 10. In this case, the water supply assembly 40 includes a water supply valve 41, a water supply hose 42, a detergent box 43, and a water supply bellows 44. The water supply valve 41 turns on or off a passage of water supplied from outside and the water supply hose 42 connects the water supply valve 41 to the detergent box 43. And, the water supply bellows 44 connects the detergent box 43 to the tub 20. Hence, once the water supply valve 41 is turned on, the water flows in the tub 20 via the water supply hose 42, detergent box 43, and water supply bellows 44. In this case, the detergent stored in the detergent box 43 is supplied to the water if necessary.

The drain assembly 50 includes a drain bellows 51, a drain pump 52, and a drain hose 53. The drain bellows 51 connects the tub 20 to the drain pump 52. One end of the drain hose 53 is connected to the drain pump 52, and the other end communicates with an outside of the cabinet 10. Once the drain pump 52 operates, water in the tub 20 is discharged outside via the drain bellows 51, drain pump 52, and drain hose 53.

Meanwhile, a control panel assembly 100 enabling a user to operate the washing machine is provided at one side of the cabinet or at an upper front side for example. The control panel assembly 100 includes a board 120, a control panel 110, and a knob 130. A structure of the control panel assembly 100 is explained in detail by referring to FIG. 3 to FIG. 5 as follows.

The board 120 is a PCB (printed circuit board for example. A switch 121 and various parts for controlling various elements such as the motor 25, water supply valve 41, drain pump 52, etc. in the washing machine are mounted on the board 120. In this case, the switch 121 has a shaft 122 enabling to rotate clockwise and counterclockwise. Once the shaft 122 is rotated, an operational time for washing, rinsing, and dewatering of the washing machine and the like are changed for example.

The control panel assembly 110 is provided at one side of the cabinet, e.g., an upper front side of the cabinet 10, as shown in FIG. 1 and FIG. 2. Yet, the location of the control panel 110 is not limited to this example. For instance, the control panel 110 may be provided on a top of the cabinet 10. The control panel 110 installed at the cabinet 10 covers the board 120 to protect.

Figure 3:
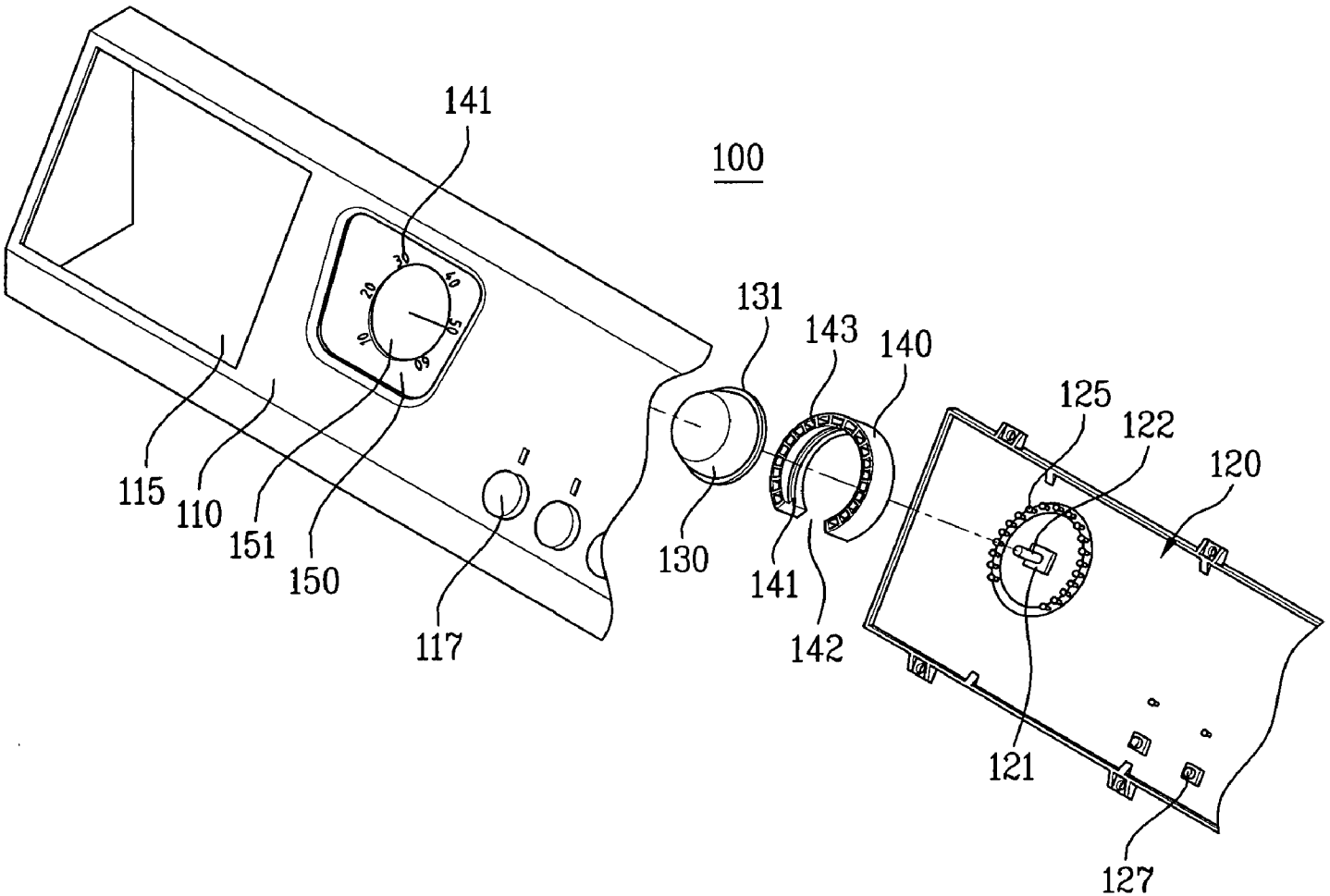
FIG. 3 is a perspective view of a disassembled control panel assembly of a washing machine in FIG. 1 according to one embodiment of the present invention.
Figure 4:
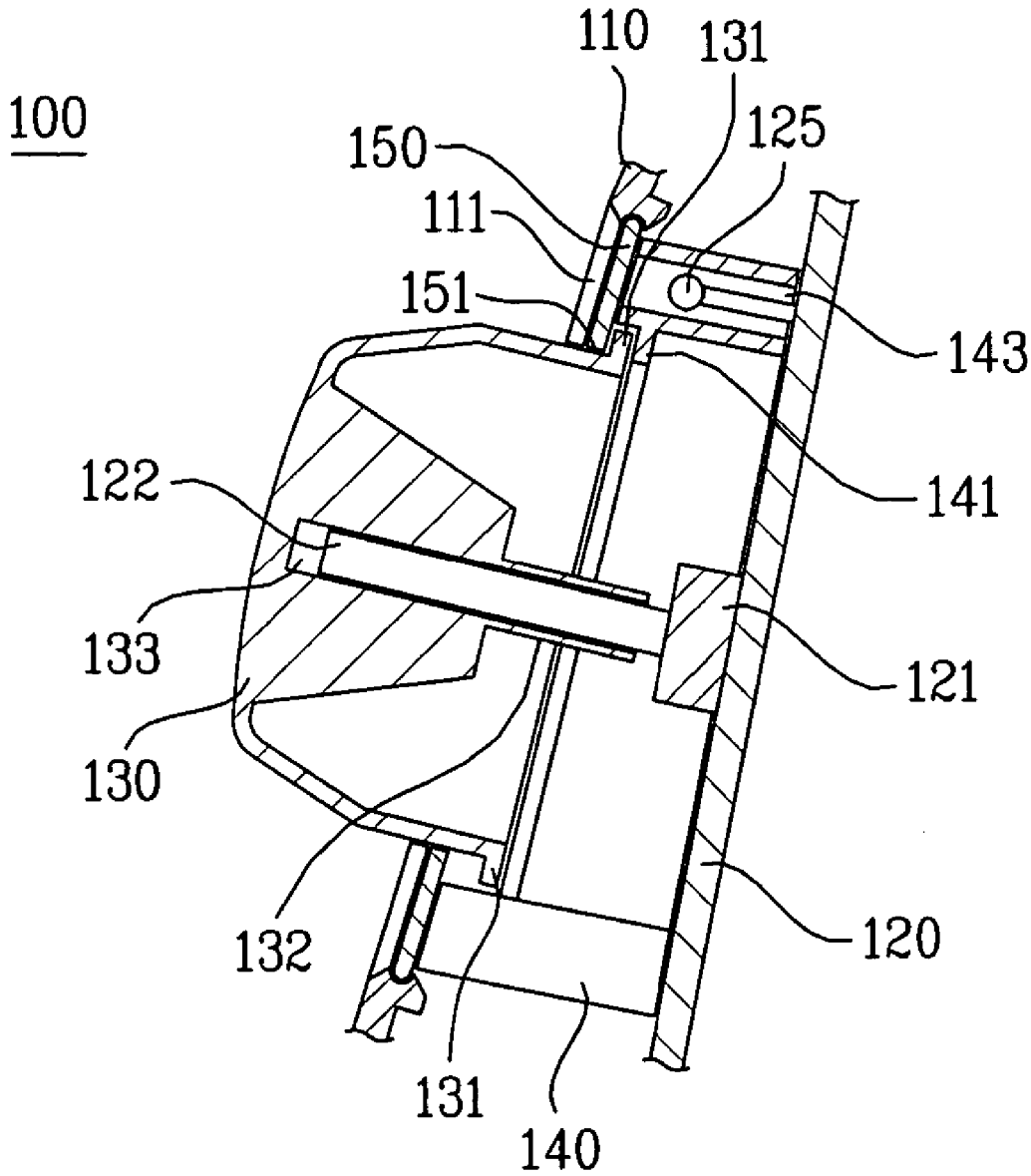
FIG. 4 is a cross-sectional view of a control panel assembly of a washing machine in FIG. 3.

Referring to FIG. 3, a hole 115 is provided at a front side of the control panel 110 to load/unload the detergent box 43. And, an opening 111, as shown in FIG. 4, is provided at the front side of the control panel 110 as well. In this case, the knob 130 penetrates the knob 130.

The knob 130 is connected to the switch, and more specifically, to the shaft 122 of the switch 121. For this, a boss 132, as shown in FIG. 4, is provided at a backside of the knob 130, and the shaft 122 is inserted in a hole 133 at a center of the boss 132 to be fixed. Meanwhile, a front side of the knob 130 is exposed outside the control panel 110, and a rear end of the knob 130 lies inside the control panel 110. Hence, a user grabs the knob 130 to turn clockwise or counter clockwise to manipulate the switch 121.

Figure 5:
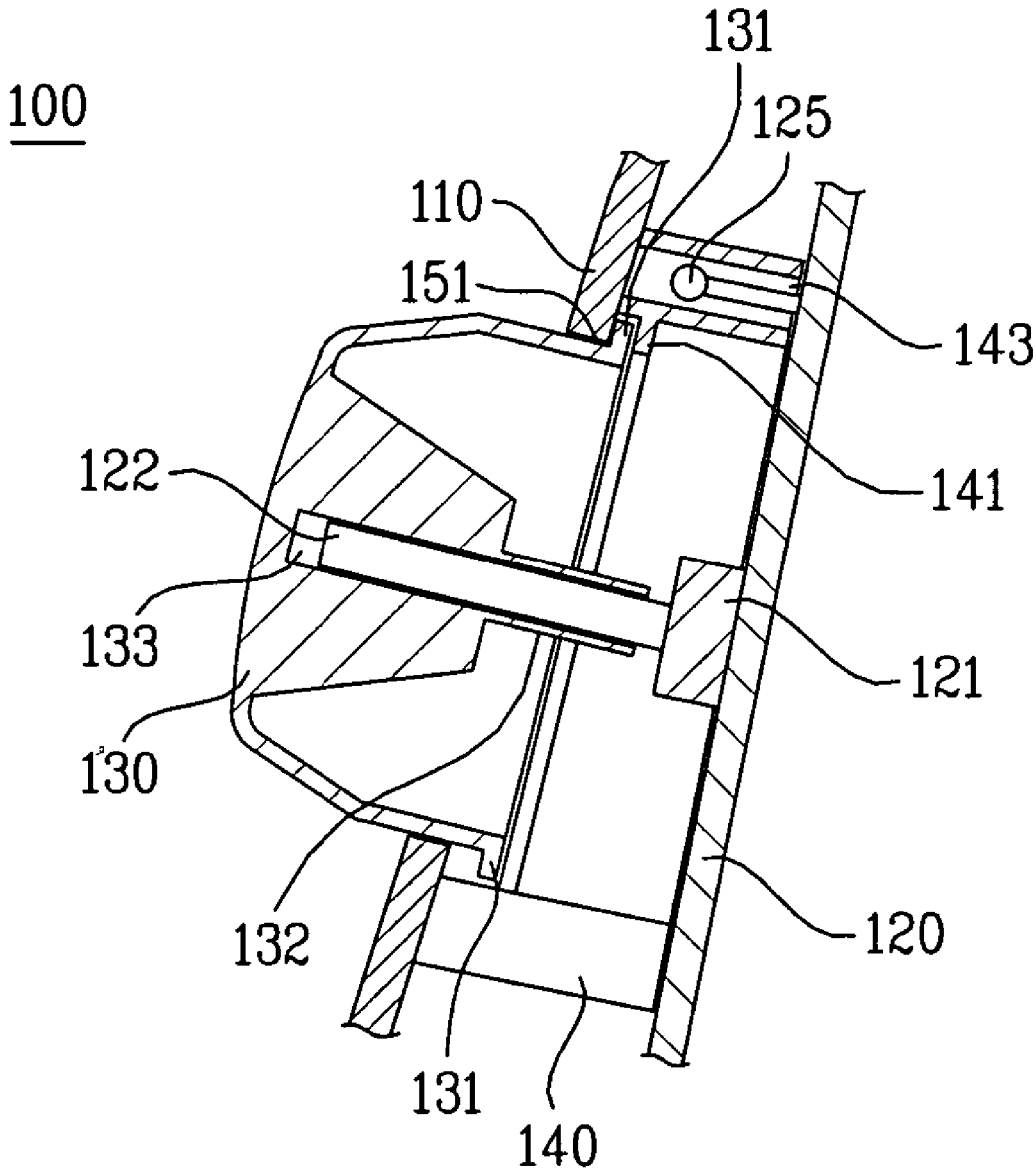
FIG. 5 is a cross-sectional view of a control panel assembly of a washing machine in FIG. 1 according to another embodiment of the present invention.

Referring to FIG. 5, a portion of the rear end of the knob 130 is provided to be brought contact with a backside of the control panel 110 only. In this case, a top of the rear end of the knob 130 is preferably installed to be brought line-contact with the backside of the control panel instead of plane-contact. For this, a rear end surface of the knob 130, as shown in FIG. 5, is disposed at a certain angle different from that of the backside of the control panel 110.

With such a structure, one side of the rear end surface of the knob 130, e.g., an upper side, is brought line-contact with the backside of the control panel 110, and the other side of the rear end surface of the knob 130, e.g., a lower side, is separated from the backside of the control panel 110 to leave a predetermined distance. Hence, when the knob 130 rotates, the rear end of the knob 130 is brought line-contact with the backside of the control panel 110 at the upper side only but other portions except the upper side are not contacted with the backside of the control panel 110. Hence, a contact area between the knob 130 and the control panel 110 is reduced, whereby the knob 130 can smoothly rotate without making a frictional noise.

Meanwhile, the knob 130 is installed while the shaft 122 of the switch 121 is coupled with the boss 132. With such a state of installation, when the knob 130 is used a lot, the knob 130 may be separated from the control panel 110. In order to prevent the knob 130 from being separated outside from the control panel 110, a flange 131 can be provided to the knob 130.

The flange 131, as shown in FIG. 3 and FIG. 4, extends along a rear circumference of the knob 130. In case that the flange 131 is provided to the knob 130, a portion of the flange 131 is brought line-contact with the backside of the control panel 110. For such a reason, the front side of the flange 131 and the backside of the control panel 110 are disposed at separate angles, respectively.

With such a structure, the contact area between the flange 131 and the control panel 110 is greatly reduced, whereby the knob 130 can rotate smoothly without making any noise. Of course, even if the knob 130 is used for a considerably long time, the knob 130 is prevented from being separated from the control panel 110.

A support 140 can be further provided to the control panel assembly 100. The support 140 is provided between the board 120 and the knob 130 and plays a role in supporting the knob 130 to be slant against the backside of the control panel 110. If the support 140 is not provided, a disposing angle of the shaft 122 is appropriately determined to dispose the rear end surface of the knob 130 or the flange 131 is arranged slant to the backside of the control panel 110 when the shaft 122 is coupled to the boss 132.

The support 140 makes the one side of the rear end of the knob 130 adhere closely to the backside of the control panel 110 and the other side of the rear end of the knob 130 separated from the backside of the control panel 110. For such a support, the support 140 may include a first face 141 obliquely supporting the rear end of the knob 130. In this case, the first faced 141 can be provided to an upper end of the support 140. Instead, the first face 141 preferably extends inward from an inner circumference of the support 140.

Supporting the knob 130 from a lower side, the support 140 is preferably provided to enclose the switch 121. With such a structure, if the first face 141 is provided to the inner circumference of the support 140, the flange 131 of the knob 130 is inserted in the center of the support 140 and is then contacted with the first face 141 to be supported.

Moreover, it is advantageous for the knob 130 to have a less portion rubbed against other elements when rotating. For this, a cut-away portion 142 failing to be contacted with the rear end of the knob 130, e.g., the flange 131, can be further provided to the support 140. The cut-away portion 142, as shown in FIG. 3, is provided to one side of the support 140, e.g., a lower side of the support 140, and reduces the contact area between the flange 131 and the support 140.

If the cut-away portion 142 is provided, it is able to reduce the noise generated from the rotation of the knob 130 more effectively as well as the knob 130 can rotate smoothly. And, the support 140 can be formed with a small amount of material, whereby a material cost is reduced.

The control panel assembly 100, as shown in FIG. 3 and FIG. 4, may further include a display plate 150. The display plate 150 is installed at the opening 111 of the control panel 110, and a hole 151 the knob 130 penetrates is provided at a center of the display plate 150. And, signs 141 such as numbers, symbols, characters, and the like are provided on the display plate 150. The signs 141 can be transparently provided and other portions of the display plate 150 can be opaquely provided. Hence, in turning the knob 130 to manipulate the washing machine, the user can refer to the signs 141 on the display plate 150.

In case of further providing the display plate 150, a portion of the rear end of the knob 130 or the flange 131 is not directly contacted with the backside of the control panel 110 but is brought contact with the backside of the display plate 150.

Meanwhile, a light-emitting member 125 may be further provided to the control panel assembly 100. The light-emitting member 125 is provided to the board 120 and includes LED for example. The light-emitting member 125, as shown in FIG. 3, can be plurally provided to enclose the switch 121. In case of further providing the light-emitting member 125, at least one aperture 143 transmitting light emitted from the light-emitting member 125 is provided to the support 140.

With such a structure, the light emitted from the light-emitting member 125 passes the aperture 143 and arrives on a backside of the display plate 150. Since the signs 141 of the display plate 150 are transparent, the light radiates through the transparent signs 142. Hence, the user enables to discern the signs with ease in the darkness for user's convenience.

Meanwhile, a plurality of tap switches 121 are provided to the board 120, and buttons 117 connected to the tab switches 121 are provided to the front side of the control panel 110. Of course, in order to discern the buttons easily, LED and window can be further provided to the board 120 and the control panel 110, respectively.

An operation of the above-constructed washing machine according to the present invention is explained as follows.

First of all, a laundry is put in the drum 30, the door 15 is closed, and the control panel 110 is then operated. In this case, the user turns the knob 130 clockwise or counterclockwise to set the time for washing, rinsing, dewatering, etc. The knob 130 having the greatly reduced contact area with other elements is smoothly turned without making any noise.

After completion of operating the control panel 110, the water supply equipment 40 then supplies water and detergent to the drum 30 appropriately. Once the drum 30 rotates, the laundry is repeatedly lifted up by the tumbling ribs 35 and to fall for washing.

After completion of washing, the drain equipment 50 discharges the used water of the drum and tub 30 and 20 outside. After completion of draining, the water supply equipment 40 supplies the drum 30 with water, the drum 30 then rotates to rinse the laundry. The drain equipment 50 then discharges the water used for rinsing outside. Such a rinsing step is performed at least once.

After completion of rinsing, the drum 30 rotates at high speed. A centrifugal force separates water contents from the laundry. After completion of dewatering, the user pulls out the washed and dewatered laundry via the door 15.

Moreover, if the washing machine is equipped with a drying function, hot air is supplied to the drum 30 to completely dry the laundry. The user then attains the completely washed and dried laundry.

Accordingly, the washing machine according to the present invention has the following advantages or effects.

First of all, the knob is turned while the upper side of the flange is contacted with the backside of the control panel or the display plate. Hence, the knob can rotate smoothly without making noise.

Secondly, the cut-away portion provided at one side of the support supporting the knob reduces greatly the contact area between the knob and the support. Therefore, the knob can smoothly rotate without making noise.

Thirdly, the support is prepared to be a ring type and the cut-away portion is provided to one side of the ring type support. Therefore, the support can be formed with less material to reduce a material cost.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A control panel assembly for a washing machine, comprising:

a board having a switch and parts mounted thereon;

a control panel installed at one side of a cabinet of the washing machine, wherein the control panel covers and protects the board;

a display plate mounted on the control panel;

a knob connected to the switch to penetrate the control panel, wherein a rear end of the knob partially contacts a backside of the display plate; and a support provided between the board and the knob, wherein the support holds the knob at a slant with respect to the backside of the control panel and wherein the support makes one side of the rear end of the knob adhere closely to the backside of the display plate while the other side of the rear end of the knob is separated from the backside of the control panel.

2. The control panel assembly as claimed in claim 1, wherein a top of the rear end of the knob is brought into line-contact with the backside of the display plate.

3. The control panel assembly as claimed in claim 1, wherein a rear end surface of the knob and the backside of the control panel are arranged to differ in angles.

4. The control panel assembly as claimed in claim 1, wherein the knob comprises a flange extending from a circumference of a rear end thereof, and wherein the flange makes line-contact with the backside of the display plate.

5. The control panel assembly as claimed in claim 4, wherein a front side of the flange and the backside of the control panel are arranged to differ in angles.

6. The control panel assembly as claimed in claim 1, wherein the support encloses the switch.

7. The control panel assembly as claimed in claim 1, wherein the support comprises a first face extending inward from an inner circumference of the support to support the rear end of the knob at a slant with respect to the backside of the control panel.

8. The control panel assembly as claimed in claim 1, wherein the support comprises a cut-away portion provided at one side of the support to reduce a contact area between the rear end of the knob and the support.

9. A control panel assembly of a washing machine, comprising:

a board having a switch and parts mounted thereon;

a control panel installed at one side of a cabinet of the washing machine, wherein the control panel covers and protects the board, the control panel having an opening;

a display plate mounted at the opening, wherein a hole is formed at a center of the display plate;

a knob connected to the switch to penetrate the opening of the control panel wherein a rear end of the knob partially contacts a backside of the display plate; and a support provided between the board and the knob to support the knob at a slant with respect to the backside of the control panel, wherein the support makes one side of the rear end of the knob adhere closely to the backside of the display plate while the other side of the rear end of the knob is separated from the backside of the control panel.

10. The control panel assembly as claimed in claim 9, wherein a top of the rear end of the knob is brought into line-contact with the backside of the display plate.

11. The control panel assembly as claimed in claim 9, wherein a rear end surface of the knob and the backside of the control panel are arranged to differ in angles.

12. The control panel assembly as claimed in claim 9, wherein the knob comprises a flange extending from a circumference of a rear end thereof, and wherein the flange makes line-contact with the backside of the display plate.

13. The control panel assembly as claimed in claim 12, wherein a front side of the flange and the backside of the control panel are arranged to differ in angles.

14. The control panel assembly as claimed in claim 9, wherein the support encloses the switch.

15. The control panel assembly as claimed in claim 9, wherein the support comprises a first face extending inward from an inner circumference of the support to support the rear end of the knob at a slant with respect to the backside of the control panel.

16. The control panel assembly as claimed in claim 9, wherein the support comprises a cut-away portion provided at one side of the support to reduce a contact area between the rear end of the knob and the support.

17. The control panel assembly as claimed in claim 9, further comprising:

a light-emitting member provided on the board; and at least one aperture provided in the support to transmit light emitted from the light-emitting member.

18. A control panel assembly of a washing machine, comprising:

a board having a switch and parts mounted thereon;

a control panel installed at one side of a cabinet of the washing machine wherein the control panel covers and protects the board, the control panel having an opening;

a display plate provided on the control panel at the opening and having a hole at a center of the display plate;

a knob connected to the switch to penetrate the opening of the control panel, wherein a rear end of the knob partially contacts a backside of the display plate; and a support provided between the board and the knob, wherein the support comprises a first face extending inward from an inner circumference of the support to support the rear end of the knob at a slant with respect to the backside of the control panel.

19. The control panel assembly of a washing machine as claimed in claim 18, wherein the support makes one side of the rear end of the knob adhere closely to the backside of the display plate while the other side of the rear end of the knob is separated from the backside of the control panel.

20. The control panel assembly of a washing machine as claimed in claim 19, wherein a top of the rear end of the knob is brought into line-contact with the backside of the display plate.

* * * * *